US005868381A

United States Patent [19]

Dahlstrom

[11] Patent Number: 5,868,381

[45] Date of Patent: Feb. 9, 1999

[54] ADJUSTABLE ANGLE LOGGING BLOCK

[75] Inventor: Gale E. Dahlstrom, P.O. Box 57, Hoquiam, Wash. 98550

[73] Assignee: Gale E. Dahlstrom, Hoquiam, Wash.

[21] Appl. No.: 795,750

[22] Filed: Feb. 6, 1997

[51] Int. Cl.[6] ..... B66D 3/04

[52] U.S. Cl. ..... 254/415; 254/403; 254/407; 104/197

[58] Field of Search ..... 254/413, 414, 254/415, 411, 409, 407; 104/197

[56] References Cited

U.S. PATENT DOCUMENTS

| | | | |
|---|---|---|---|
| 499,323 | 6/1893 | Hoit | 254/413 |
| 1,085,017 | 1/1914 | Card | 254/407 |
| 1,181,898 | 5/1916 | La Croix | 254/409 |
| 1,206,264 | 11/1916 | Simpson | 254/415 |
| 1,481,077 | 1/1924 | Adams | 254/414 |
| 2,182,602 | 12/1939 | Veteran | 254/407 |
| 2,218,854 | 10/1940 | Rabelos | 254/407 |
| 2,665,114 | 1/1954 | Michalski | 254/407 |
| 5,673,625 | 10/1997 | Dahlstrom | 104/173.1 |

*Primary Examiner*—Katherine Matecki
*Attorney, Agent, or Firm*—Christensen O'Connor Johnson Kindness PLLC

[57] ABSTRACT

A logging block (16) formed in accordance with the present invention includes a frame (56) having a first end and an opposing second end and a sheave (50) having an upper side (58) and an opposing lower side (62) coupled to the second end of the frame such that the sheave rotatably contacts a continuous loop of cable (12) as the cable travels along a mono-cable path (32). Located at the first end of the frame (56) is a mounting assembly (77) providing at least two mounting slots (78) used for securing the frame to a stationary object along the mono-cable path (32), such as a tree or stump (20). The mounting slots (78) are positioned with respect to the sheave (50) such that when the logging block (16) is in operation, the alignment of a mounting slot is either above, below or directly in line with the sheave. By altering the alignment of the mounting slot (78) with respect to the sheave (50), the position of logging blocks (16) along the mono-cable path (32) can be significantly altered without sacrificing the functionality of the logging block or increasing dangers associated with misalignment of the cable (12) with respect to the logging block as the cable travels along the mono-cable path.

19 Claims, 9 Drawing Sheets

10
12
14
16
18
20
22
24
32
34
36a
36b
38
40
42
44

ADJUSTABLE ANGLE LOGGING BLOCK

FIELD OF THE INVENTION

The present invention relates to log yarding equipment using a mono-cable extending through an area from which selected logs are to be removed.

BACKGROUND OF THE INVENTION

Current logging practices are undergoing significant changes due to the increased opposition to clear cutting as a means for harvesting timber. In traditional clear cutting, all trees are harvested, and in order to remove the fallen trees, conventional yarding equipment has been used to retrieve the logs from between stumps to a location where they are loaded onto trailers for subsequent transport away from the logging area. One way to harvest timber without clear cutting of this nature is to remove selected trees from a given area while leaving many existing trees standing. This selective harvesting of timber is often referred to as thinning.

In order to meet demands of better thinning and selective harvesting of timber, logging equipment has been developed that allows fallen trees to be removed by a more circuitous route through the trees that remain standing than by using the straight, clear-cut path retrieval of conventional line systems. Such logging equipment can transport harvested trees along a meandering path to a location where they are loaded on trailers for subsequent transport from the logging area. One such system for thinning trees is known as a mono-cable system. The mono-cable system relies on a continuous loop of cable that is strung through a logging area along the path that the harvested timber is conveyed. The cable is generally fixed in length and driven by a mechanical means such as a hydraulic motor. Conventional choking equipment, including chokers, hooks, and stoppers, are used in conjunction with the cable to secure felled trees to the cable. Logging blocks having radially extending teeth are secured to standing trees or stumps, and are used to support and guide the cable along the path, as well as to change its direction through the logging area.

In one existing mono-cable system, the cable is provided with a plurality of annular sleeves secured along the length of the cable at intermittent locations. These sleeves act as the stoppers for the hooks that hang freely on the cable from one end and have at their opposite end a choker for securing a log or logs. In operation, the choker can be slid along the cable to a felled log and, if necessary, the cable itself can be advanced to assist in positioning the choker with respect to a log. Once the log is secured, the mono-cable system is advanced, causing the cable to slide through the hook until a stopper is reached, whereupon the stopper engages the hook and advances it along with the cable. The cable, stopper, hook, choker and secured log or logs are then transported along the meandering mono-cable system path—along the path determined by the location of the blocks—to the point where they are conveniently loaded onto trailers.

Conventional logging blocks used in such mono-cable systems include a sheave or pulley that has a groove or channel in which the mono-cable is seated during normal operation. The groove is defined between two rails on opposite sides of the sheave. One rail is substantially smooth and has an outer diameter that is equal to or greater than the diameter of the groove in the sheave. The opposite rail may also be substantially smooth or, as is more common, comprise a plurality of radially extending teeth. In the conventional blocks, these teeth are machined into the sheave rail or are rigidly affixed thereto. The sheave and corresponding rails are rotatably mounted to a frame which serves to carry the combination and secure it to a tree or stump via a harness such as a cable or belt. The harness is looped around the tree or stump and through a notch or hole cut into the frame, thereby anchoring the block to the tree or stump.

When tension on the mono-cable is increased by activating the winch, the blocks which have been secured to a tree or stump are extended horizontally relative to their anchor by the force of the taut cable in the direction away from the tree or stump. In this position, the side of each block with the radial extending teeth is below the smooth rail and essentially parallel with the ground. During normal operation, the cable rides in the groove of the sheave. As a portion of the mono-cable carrying the hook enters the block and begins to pass along the groove of the sheave, the vertically oriented hook either seats itself between the protruding teeth or contacts a tooth along its sides or at its end and the protruding teeth advance the cable and associated hook and sleeve along the sheave.

Because of the high tension on the mono-cable, the potential for injury to hookers or other logging personnel in the area is great if the cable jumps the block. Additionally, the down time involved in restringing the mono-cable onto a block adds to the overall cost of the logging operation. The potential for the hook assembly to jump off the logging block relates to a number of factors, not the least of which is the ability of the sheave to twist to maintain proper alignment with the incoming weighted cable. More specifically, as a portion of the mono-cable carrying the hook approaches the horizontally extended sheave, the weight of the associated secured log pulls downward against the cable and sheave on the side of the sheave closest to the approaching hook. This downward force tends to twist the sheave on its anchor away from horizontal and towards alignment with the approaching weighted cable. This aligns the protruding teeth of the sheave with the weighted cable and hook so that the hook correctly seats itself between the teeth. Twisting of the sheave is therefore necessary to prevent or reduce the likelihood that the cable will jump off the logging block.

The ability of the sheave to twist to accommodate the incoming weighted cable and hook depends on the amount of cable contact with the sheave. Very little cable contact reduces the twisting force on the sheave as the weighted cable and hook approaches. The cable itself rather than the sheave is likely to be forced downward and possibly off the block. Conversely, greater cable contact with the sheave forces the sheave itself to twist.

Perhaps the most significant factor affecting cable contact with the sheave is the angle between adjacent logging blocks. The smaller the angle between adjacent logging blocks, the greater the cable contact with the surface of the sheave. Traditional logging blocks in existing mono-cable systems are anchored on nearby trees along the desired mono-cable path in roughly the same plane such that the angle at any given logging block between adjacent logging blocks to either side is approximately 90° to 125°. This allows a meandering mono-cable path that is predominately jagged in appearance. By aligning the harness looped through the notch or hole cut into the frame of the logging block with the center of the groove of the sheave, maximum force on the block extending it horizontally away from the anchor—and therefore maximum contact between the cable and the surface of the sheave—is ensured at any given moment during mono-cable system operation within this range.

As the angle between adjacent logging blocks is increased beyond approximately 120°, however, such as in an attempt to obtain a straighter mono-cable path, less cable is in contact with the sheave. Equivalent cable force on the logging block at the higher angle therefore increases the pull of the cable away from the surface of the sheave. This decreases the cable force extending the block horizontally away from the anchor. Reduced cable force maintaining the mono-cable on the sheave decreases the ability of the sheave to twist to align itself with the approaching hook and log. This, in turn, increases the likelihood that the cable will jump the block.

The distance between adjacent logging blocks also affects the ability of the sheave to twist. The shorter the distance between the current logging block (through which the weighted cable is passing) and the subsequent logging block (the next logging block along the mono-cable path), the less flexibility the current logging block sheave has to twist. The closer the two sheaves the more tension that exists along the cable between the sheaves, thus constraining the twisting of the current sheave. The greater the distance between these sheaves, however, the less tension along the cable, and the greater the twisting flexibility of the current sheave.

Given that the topography of each logging area varies tremendously, the distance between adjacent logging blocks in a mono-cable system cannot always be ideally set to achieve the necessary sheave twist. The spacing between trees, for example, may force placement of logging blocks closer to each other than desired along a given mono-cable path. To compensate for the variance in distance between logging blocks mandated by the logging area, the relative plane in which adjacent logging blocks sit may be adjusted. While anchoring a subsequent logging block relatively close to a current logging block in the same relative plane reduces possible sheave twisting in response to approaching hooks with associated secured logs, anchoring the subsequent block in a higher plane relative to the current block pre-stresses the block to twist towards the approaching hook. Adjusting the relative plane in which adjacent logging blocks sit thus compensates for variances in distance between blocks.

In sum, the potential for the hook assembly to jump off the logging block is related to (1) the angle between adjacent logging blocks, (2) the distance between adjacent logging blocks, and (3) the relative plane in which adjacent logging blocks sit. Each of these factors affects the forces between the cable and the surface of the sheave and, thus, the proper functioning of the mono-cable system.

Accordingly, to avoid risking injury and additional costs associated with the cable jumping the block in mono-cable system operation, the placement of traditional logging blocks along a mono-cable path has heretofore been extremely limited by angular range, plane, and distance between adjacent logging blocks. This limitation restricts logging personnel in their choice of mono-cable paths, forcing them to adopt paths that are either not as efficient in maximizing thinning efforts for any given tree stand, or not possible given the location of existing stumps and the topography of the logging area.

Although mono-cable systems and conventional blocks are in use, there is a need for an improved logging block that provides increased flexibility in the placement of logging blocks between mounting trees forming a mono-cable path while reducing the likelihood that the mono-cable will jump the block. By so doing, the improved logging block would increase the usefulness and efficiency of the mono-cable logging system while reducing the risk of injury to logging personnel and associated economic loss.

SUMMARY OF THE INVENTION

In accordance with the present invention, a logging block for use in a mono-cable system having a continuous loop of cable strung through a logging area along a mono-cable path is provided. The improved logging block provides greater flexibility in the placement of logging blocks between mounting trees or stumps along the mono-cable path while reducing the likelihood that the mono-cable will jump the block.

A logging block formed in accordance with the present invention includes a frame having a first end and an opposing second end and a sheave having an upper side and an opposing lower side coupled to the second end of the frame such that the sheave rotatably contacts the continuous loop of cable as the cable travels along the mono-cable path. Located at the first end of the frame is a mounting assembly providing at least two distinct mounting slots used for securing the frame to a stationary object along the mono-cable path, such as a tree or stump, by means of a mounting harness. The mounting assembly allows selectable use of different mounting slots to position the frame with respect to the sheave so that when the logging block is in operation, the mounting harness securing the frame is aligned either above, below, or directly in line with the sheave. By altering the alignment of the mounting harness with respect to the sheave, the position of logging blocks along the mono-cable path can be significantly altered without sacrificing the functionality of the logging block or increasing dangers associated with misalignment of the cable with respect to the logging block as the cable travels along the mono-cable path.

In accordance with other aspects of the present invention, the upper side of the sheave includes a radially extending rib, the lower side of the sheave includes a radially extending rib, and a groove having a bottom is defined between the radially extending ribs of the upper and lower sides. The bottom of the groove has a diameter less than the diameter of the radially extending ribs of the upper and lower sides.

In accordance with other aspects of the present invention, the lower side of the sheave is substantially round and includes a radial extending rib having radial protrusions equally spaced around its periphery. In a preferred embodiment, the radial protrusions are substantially triangular in shape, number greater than nine, and are used to maintain the mono-cable's position along the sheave and to advance the cable along the mono-cable path.

In accordance with further aspects of the present invention, the logging block has a groove defined between the upper side of the sheave and the radially extending rib of the lower side of the sheave. In a preferred embodiment, the groove has a first diameter, the radial protrusions include radial ends, and a circle that substantially circumscribes the radial ends defines a second diameter that is greater than the first diameter. In an alternate embodiment, the upper side of the sheave includes a radial extending rib, the groove has a first diameter, and the upper side has a second diameter that is greater than the first diameter.

In accordance with still other aspects of the present invention, the logging block further includes a side plate secured adjacent to the sheave that is rotatable relative to the sheave. The side plate is substantially round and includes a plurality of radial protrusions that are preferably equally spaced around a periphery of the side plate. In a preferred embodiment, the radial protrusions are substantially triangular in shape and number greater than nine.

BRIEF DESCRIPTION OF THE DRAWINGS

The foregoing aspects and many of the attendant advantages of this invention will become more readily appreciated as the same becomes better understood by reference to the following detailed description, when taken in conjunction with the accompanying drawings, wherein.

DETAILED DESCRIPTION OF THE PREFERRED EMBODIMENT

Figure 1:
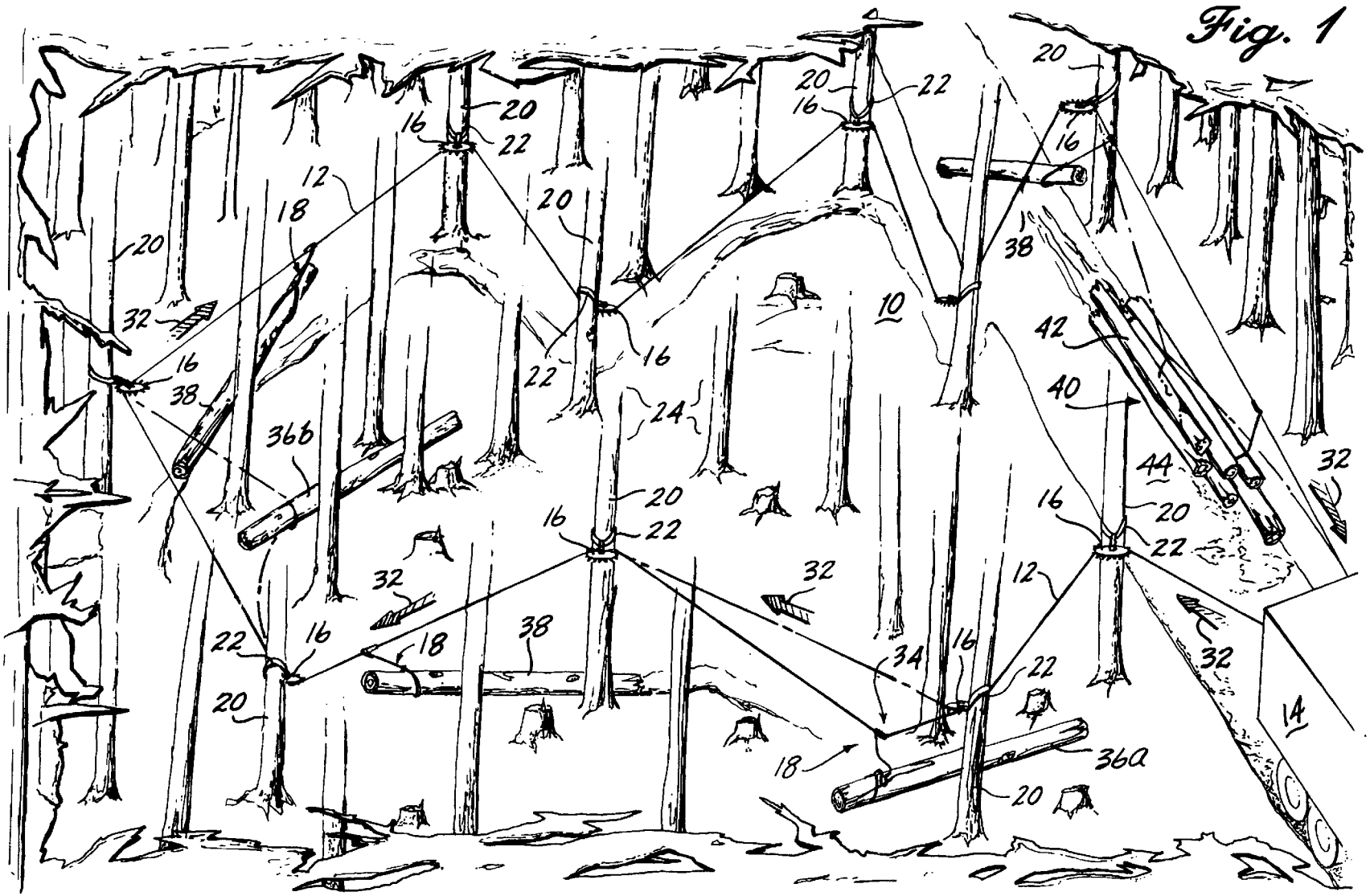
FIG. 1 is an environmental view of a conventional mono-cable system employing a logging block formed in accordance with the present invention, wherein the mono-cable system includes a power system and a continuous loop of cable strung through a logging area along a path that the harvested timber is conveyed.

FIG. 1 shows a mono-cable system 10 employing a logging block formed in accordance with the present invention. The mono-cable system 10 includes a cable 12, a power system 14, logging blocks 16 through which cable 12 passes, and log-securing assemblies 18. In the illustrated embodiment, cable 12 is generally manufactured from a high tensile strength material, such as steel, which is strung through an area to be logged, thereby defining the path of the mono-cable system through a stand of trees.

Cable 12 is guided through the logging area by logging blocks 16, which in turn are attached to mounting trees 20, that are either trees not to be removed or stumps, by use of conventional harnesses 22. Logging block 16 used in the present invention operates generally like a free-wheeling pulley. By use of logging block 16 and conventional harnesses 22 placed intermittently along the mono-cable system path, when cable 12 is taut, it is suspended above the ground 24.

Figure 2:
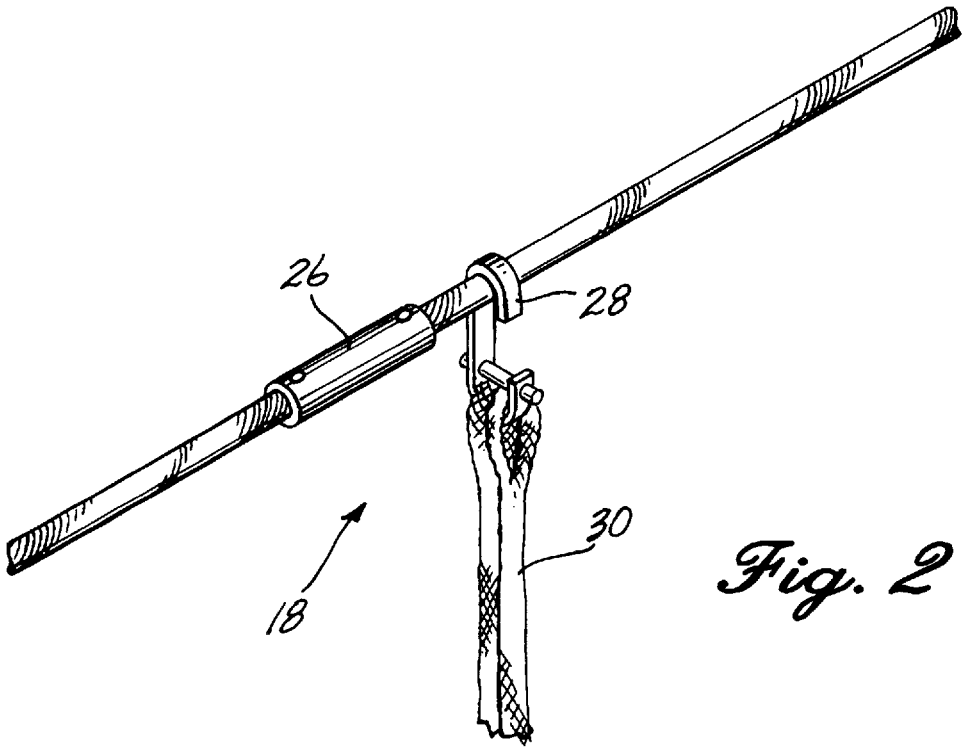
FIG. 2 is a detailed perspective view of a log securing system used in combination with a logging block of the present invention.

As better understood by reference to FIG. 2 in conjunction with FIG. 1, each log securing assembly 18 includes a stopper 26, a hook 28, and a choker 30. A plurality of stoppers 26, which are shown as annular sleeves in the illustrated embodiment, are secured intermittently along the length of the cable 12. Stoppers 26 have conventionally been made from an annular metal sleeve which, due to its inflexibility and the constant movement of the cable, frequently causes the cable to wear and break along the placement of the stopper. It should be appreciated that stoppers 26 can also be made of flexible annular materials such as hydraulic hose and held in place along the cable by use of screws, which reduces wear and breakage of the cable. A conventional hook is employed to ride on the cable 12 between each intermittent stopper 26. Each hook serves to slidably attach choker 30 to the cable. In the illustrated embodiment, each hook 28 includes one end having a hooked member with a gap large enough to pass over cable 12, while the opposite end of the hook includes a means such as a clevis for securing the hook to choker 30.

It should be understood that cable 12, log-securing assembly 18, and harnesses 22, used in conjunction with the present invention, are conventional and are well-known to one of ordinary skill in the logging art. It shall also be appreciated that the illustrated embodiment of the log-securing assembly is just one configuration which has utility in the present application. Other types of stoppers, hooks, and chokers that include different means for securing a log in the mono-cable system can also be used in accordance with the present invention. Other types of harnesses 22 used to attach logging blocks 16 to mounting trees 20 are also contemplated. In one example, a harness 22 includes a nylon strap ratcheted to a mounting tree, a hook affixed to the nylon strap, and two intertwined loops of cable, one loop attached to the logging block slot of the mounting assembly of a logging block frame. This harness configuration would allow either one or both ends of the intertwined loops of cable to be attached via the hook to the nylon strap, depending on the desired distance between the mounting tree and the logging block.

Figure 3:
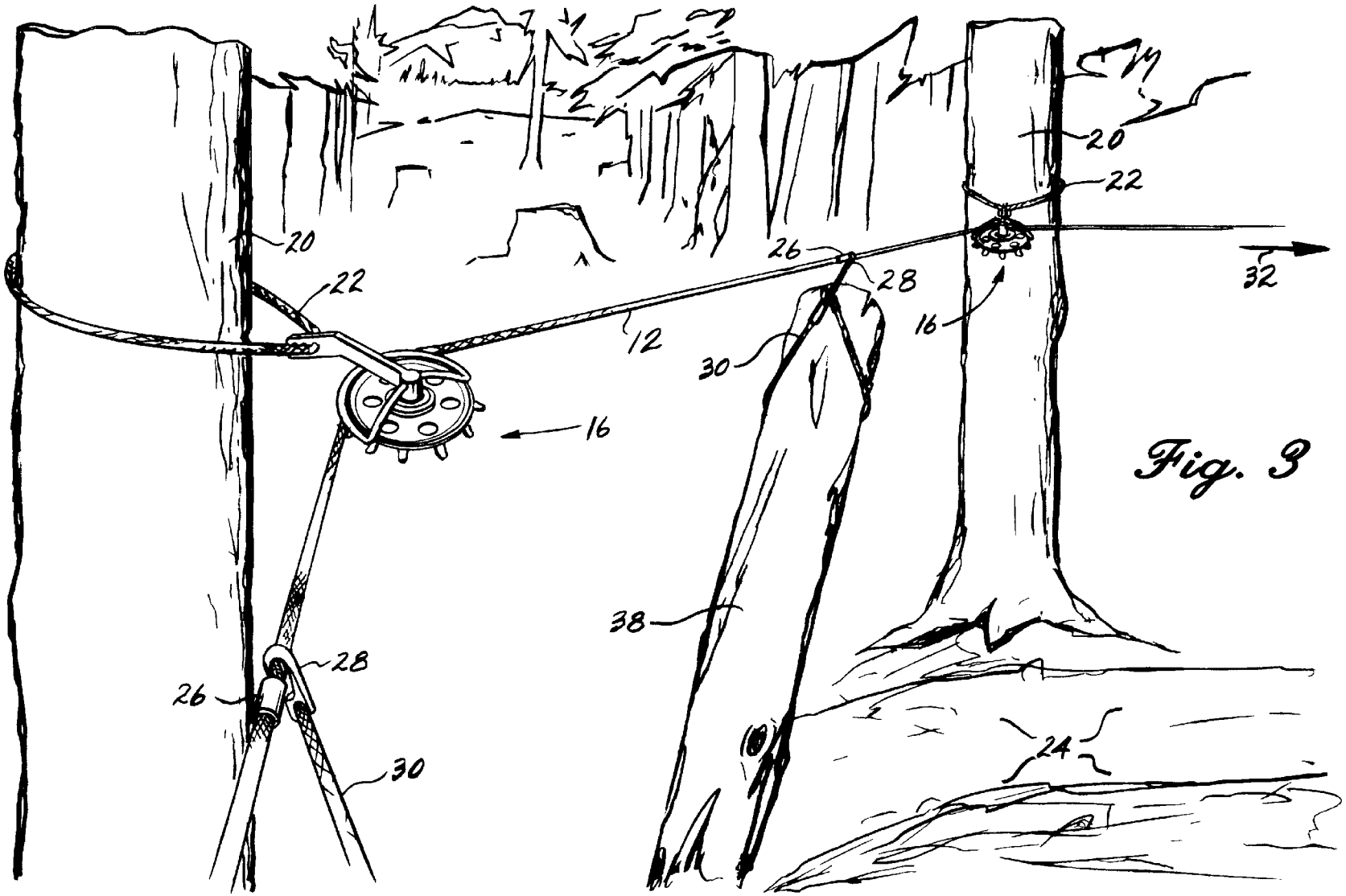
FIG. 3 is a close-up environmental view of a conventional mono-cable system employing a logging block formed in accordance with the present invention.

Continuing to refer to FIG. 1 in conjunction with FIG. 3, under conventional operation of the mono-cable system, power system 14 drives cable 12 along the path of the mono-cable system as indicated by direction arrows 32. The movement of the cable carries log-securing assembly 18 to a location indicated by arrow 34 along the path of the mono-cable system where fallen logs 36 are located. After fallen log or logs 36 are secured to cable 12 by means of log securing assembly 18, the cable is advanced, continuing along the path of the mono-cable system. If the friction between hook 28 and cable 12 is not great enough to prevent the cable from moving through the hook, the hook will eventually be engaged by stopper 26, at which point the hook and associated secured log 38 will be forced to move along predetermined path 32 of the mono-cable system.

Secured logs 38 are subsequently carried along the path of the mono-cable system to a transport location indicated by arrow 40 where, in conventional mono-cable systems, hook 28 at log securing assembly 18 is disengaged from cable 12, leaving transported logs 42 by a logging road 44 where they can eventually be loaded onto logging transport (not shown) for removal from the logging area.

Figure 4A:
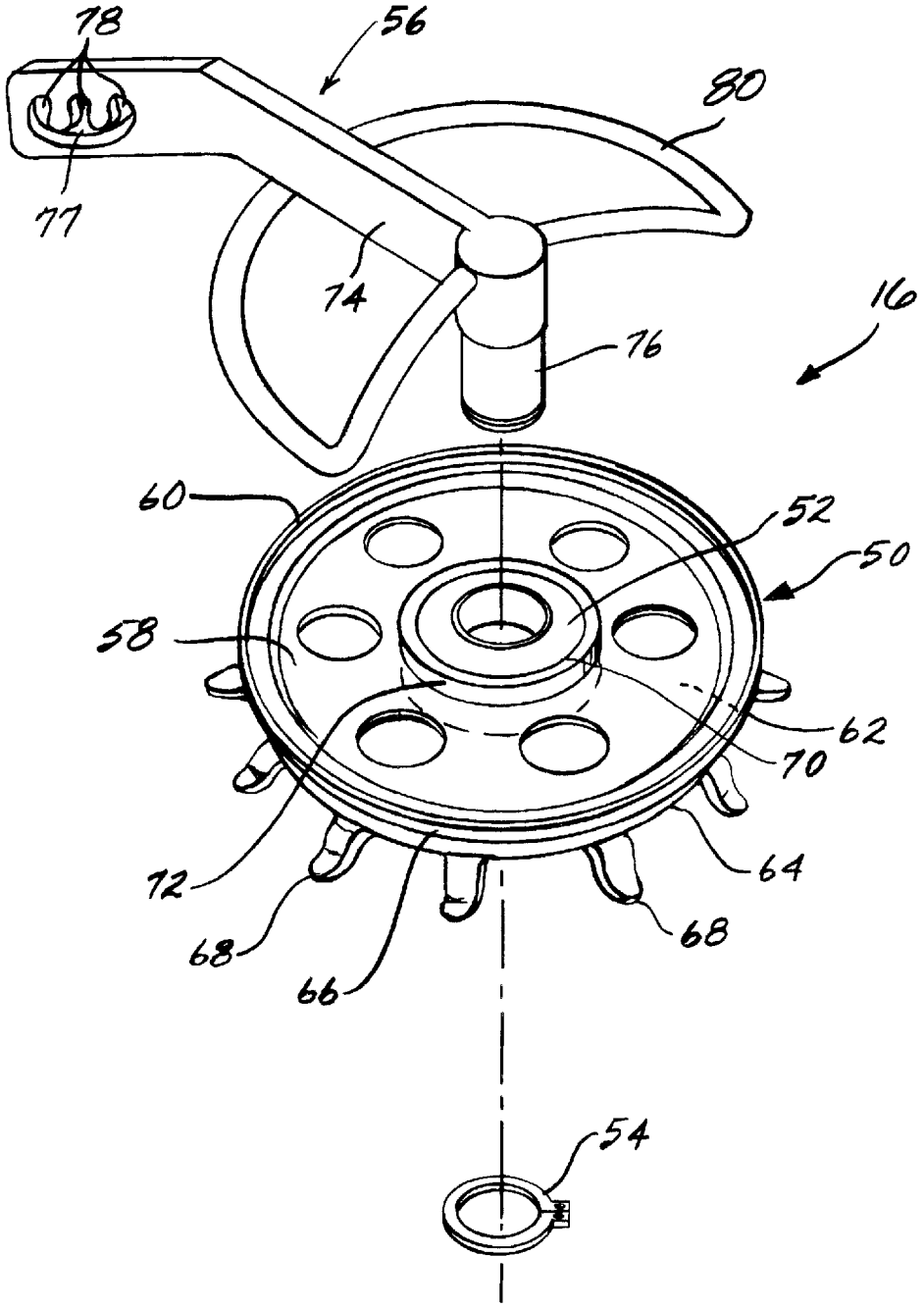
FIG. 4A is an exploded perspective view of a logging block formed in accordance with the present invention wherein the logging block includes a sheave having a rail on one side comprising a plurality of radially extending teeth.

The illustrated embodiment of a logging block formed in accordance with the present invention operates generally like a pulley. Referring to FIG. 4A, one embodiment of a logging block 16 formed in accordance with the present invention includes a sheave 50, a bearing 52, a key ring 54 and a frame 56. The sheave 50 is generally circular and has an upper side 58 with an upper side rail 60, and a lower side 62 with a lower side rail 64. In a preferred embodiment, sheave 50 has a diameter of approximately seven (7) inches. Upper and lower rails 60 and 64 are of a design found on sheaves of conventional pulleys for steel cables, and define a groove 66 that in normal operation serves as a seat for the mono cable. In the illustrated embodiment, lower rail 64 also includes triangular extending protrusions 68, the ends of which generally circumscribe a circle. It should be understood that use of side rails 60 and 64 without protrusions 68 is also contemplated within the scope of the present invention. Passing through sheave 50 from upper side 58 to lower side 62 centered along the axial centerline is a bore 70 for receiving the conventional bearing 52. In the illustrated embodiment, bore 70 is surrounded by a bearing housing 72. Bearing housing 72 has an inner diameter that defines bore 70 for receiving bearing 52.

Sheave 50 is rotatably mounted to frame 56, which serves to carry the combination and secure it to mounting tree 20 via harness 22. Frame 56 includes an elongate body 74 having a length greater than the diameter of the circle circumscribed by sheave 50. It will be appreciated that elongate body 74 could also be made adjustable so that the length of the elongate body could be increased or decreased according to specific usage of the logging block without departing from the scope of the present invention. On one end of elongate body 74 extending downward perpendicular to the length of the body is an axle 76. When assembled, axle 76 will be received within bearing 52. The end of axle 76, which passes through bearing 52, receives key ring 54, and serves to secure sheave 50 thereto.

The opposite end of elongate body 74 includes a mounting assembly 77. In a preferred embodiment, mounting assembly 77 includes three mounting slots 78 cut into the frame body for securing frame 56 to mounting harness 22 attached to mounting tree 20. As will be discussed in greater detail below, the opposite end of elongate body 74 of frame 56, including mounting slots 78, is angled such that each of the three mounting slots are positioned differently with respect to sheave 50 when viewed in a plane parallel to upper and lower sides 58 and 62, respectively. The distance between axle 76 and mounting slot 78 closest to the axle in this preferred embodiment is approximately nine (9) inches.

It will be appreciated that the use of mounting slots 78 cut into the frame body is only one embodiment of a mounting assembly contemplated by the present invention. Equivalently, the mounting assembly could be comprised of a single mounting aperture cut into the frame body and one or more slot dividers. Each slot divider would define multiple distinct mounting slots capable of receiving mounting harness 22, with each mounting aperture dividing the mounting aperture into two subsections. The slot dividers would be adjustable so that each mounting slot so defined would be positionable differently with respect to sheave 50 when viewed in a plane parallel to upper and lower sides 58 and 62, respectively. The slot dividers would be fixable at the various positions along the mounting aperture to ensure maintenance of the mounting slot position selected.

Attached to the underside of elongate body 74 and to axle 76 is a guide member 80 shaped to prevent the mono-cable from becoming wedged between elongate body 74 and sheave 50. Guide member 80 is generally semi-circular in shape as it extends from elongate body 74 around sheave 50 on each side of the sheave and has a diameter that is slightly greater than the diameter of sheave 50. In a preferred embodiment, the circular periphery of guide member 80 is centered on the same axis as the periphery of upper side rail 60, and guide member 80 is positioned in substantially the same plane as upper side rail 60. Guide member 80 is positioned close enough to upper side rail 60 of sheave 50 to prevent cable 12 from sliding off the sheave between the upper side rail and the guide member. Guide member 80 extends around sheave 50 about 90° on each side of the sheave, at which point each end of guide member 80 distant from elongate body 74 extends away from sheave 50 and attaches to axle 76 for added strength to the guide member. It will be appreciated that the shape, material used, and extension of guide member 80 around sheave 50 can vary according to specific usage of the logging block without departing from the scope of the present invention.

It should be understood that while a particular embodiment of the frame is described above, other shapes of plates and hook members can be employed in order to further facilitate the retention of the mono-cable on the block. In one specific alternate embodiment shown in FIG. 4B, the logging block further includes a side plate 84 and a collar 88. In this alternate embodiment, lower rail 64 on lower side 62 is substantially removed to allow side plate 84 to be secured adjacent lower side 62 of sheave 50. As noted above, bore 70, which passes through sheave 50 from upper side 58 to lower side 62 centered along the actual centerline, is surrounded by bearing housing 72. As described in more detail below, the outer diameter of bearing housing 72 extends perpendicularly from the lower side of sheave 50 a distance sufficient to provide an axle for side plate 84 and a seat for collar 88.

Side plate 84 has a circular body 90 having an outer diameter substantially equal to the outer diameter of lower side 62 of sheave 50. Extending radially from body 90 are protrusions or teeth 92, which in the illustrated embodiment are substantially triangular. It should be understood that while the illustrated protrusions are triangular, other shapes as well as greater or lesser numbers of teeth 92 can be employed. A side plate bore 86 passes through the center of body 90. The side plate bore has a diameter slightly greater than the outer diameter of bearing housing 72 on lower side 62 of sheave 50. When assembled, side plate bore 86 within side plate 84 will receive bearing housing 72. A portion of the bearing housing will extend beyond the face of side plate 84 opposite the sheave. Collar 88 is welded to the exposed end of bearing housing 86 in order to rotatably secure side plate 84 adjacent lower side 62 of sheave 50. While the logging block formed in accordance with the present invention has been described above with respect to a particular embodiment, it should be understood that other configurations of the bearing and rotatable mounting of the side plate relative to the sheave are within the scope of the present invention. Applicants have described above only one means for positioning the side plate adjacent the sheave in a manner that allows the side plate to be freely rotatable relative to the sheave.

Figure 5A:
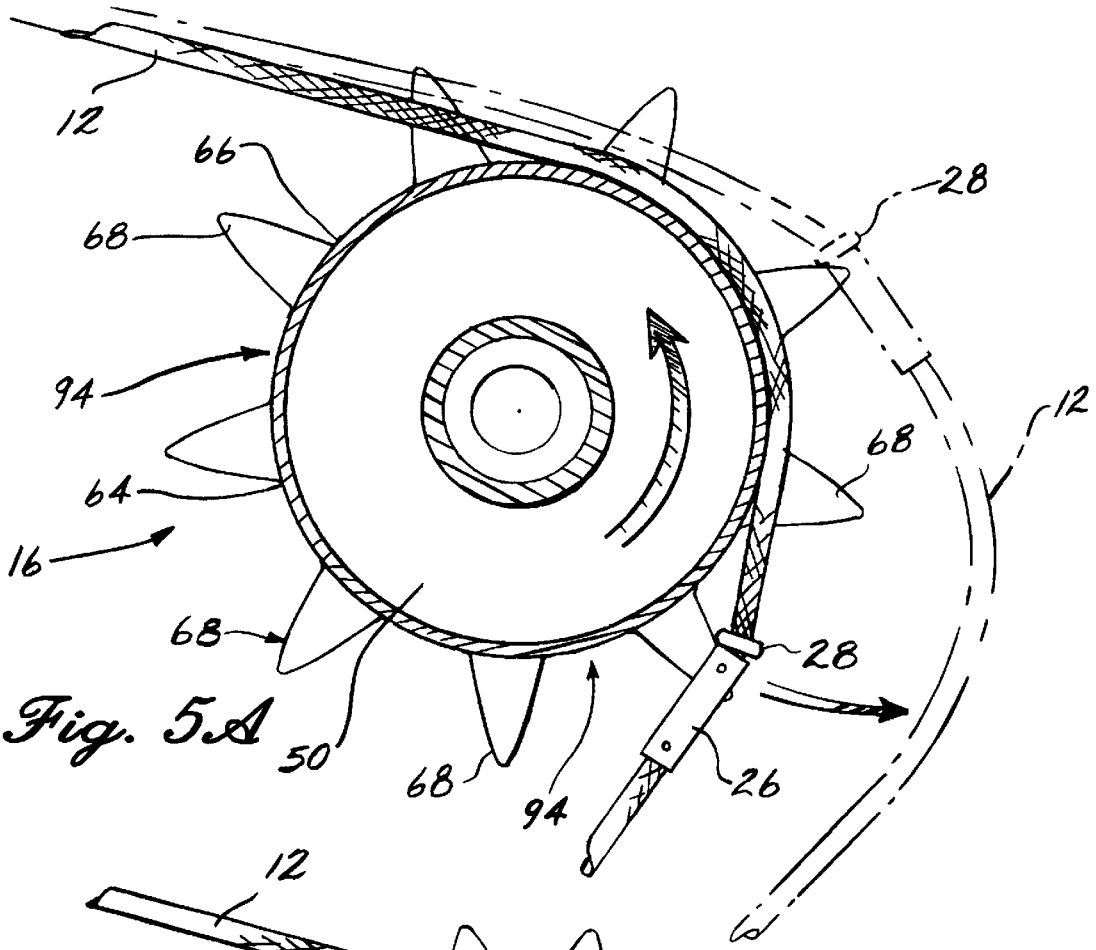
FIG. 5A is a close-up view of a sequence illustrating a hook on a mono-cable system being received by and passed through a logging block formed in accordance with the present invention wherein the logging block includes a sheave having a rail on one side comprising a plurality of radially extending teeth.
Figure 5B:
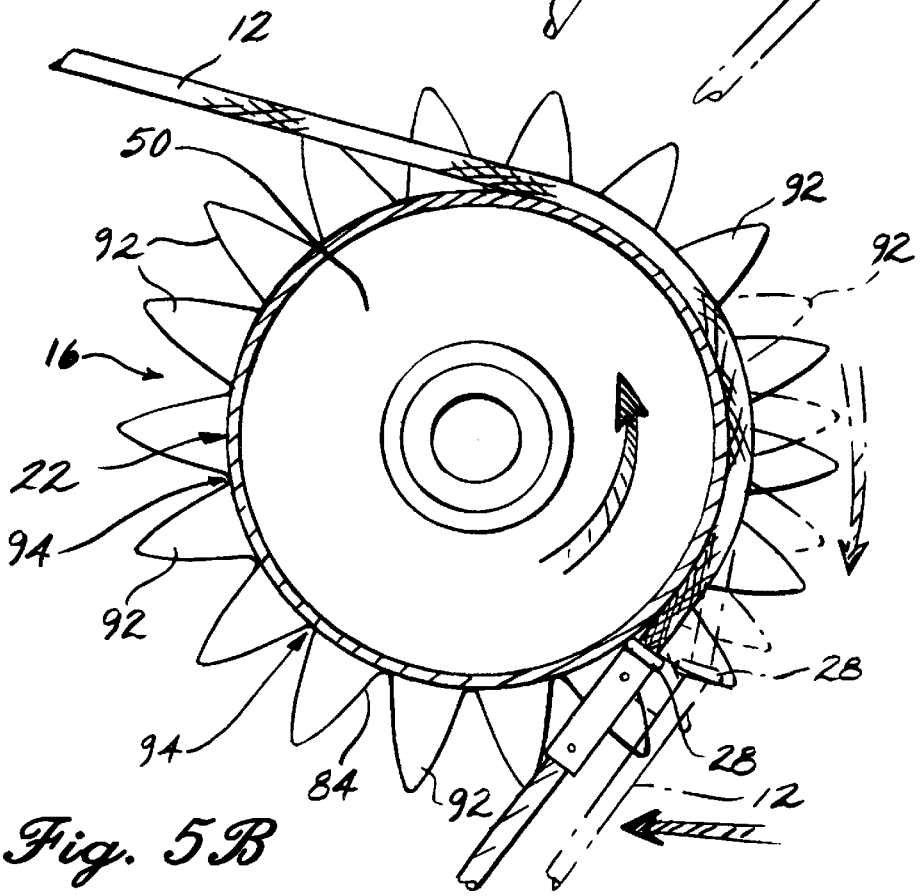
FIG. 5B is a close-up view of a sequence illustrating a hook on a mono-cable system being received by and passed through a logging block formed in accordance with the present invention wherein the logging block includes a sheave having a side plate comprising a plurality of radially extending teeth rotatably secured adjacent the sheave.

The operation of the sheave assemblies can better be understood by reference to FIGS. 5A and 5B. FIG. 5A shows the operation of the logging block using the sheave assembly set forth above with reference to FIG. 4A. Specifically, as noted above, in a logging block 16, cable 12 rides in groove 66 of sheave 50. As hook 28 and stopper sleeve 26 approach logging block 16, the hook contacts the sheave either in trough 94 between adjacent teeth 68 or along the angled edges of a given tooth. If hook 28 contacts lower rail 64 centered within the trough, teeth 68 will help guide the hook around the block along with cable 12. When a hook is centered between adjacent teeth 68, the hook assembly generally passes smoothly through logging block 16. However, if hook 28 contacts a tooth at a location other than trough 94 between adjacent teeth, there is a tendency to pull cable 12 out of the trough and off of sheave 50, which increases the risk that the mono-cable will jump the block. For example, if the hook contacts a tooth along its angled side or its radial end, the cable will tend to follow the hook and be pulled out of the trough of the groove (depicted by phantom lines in FIG. 5A).

Figure 4B:
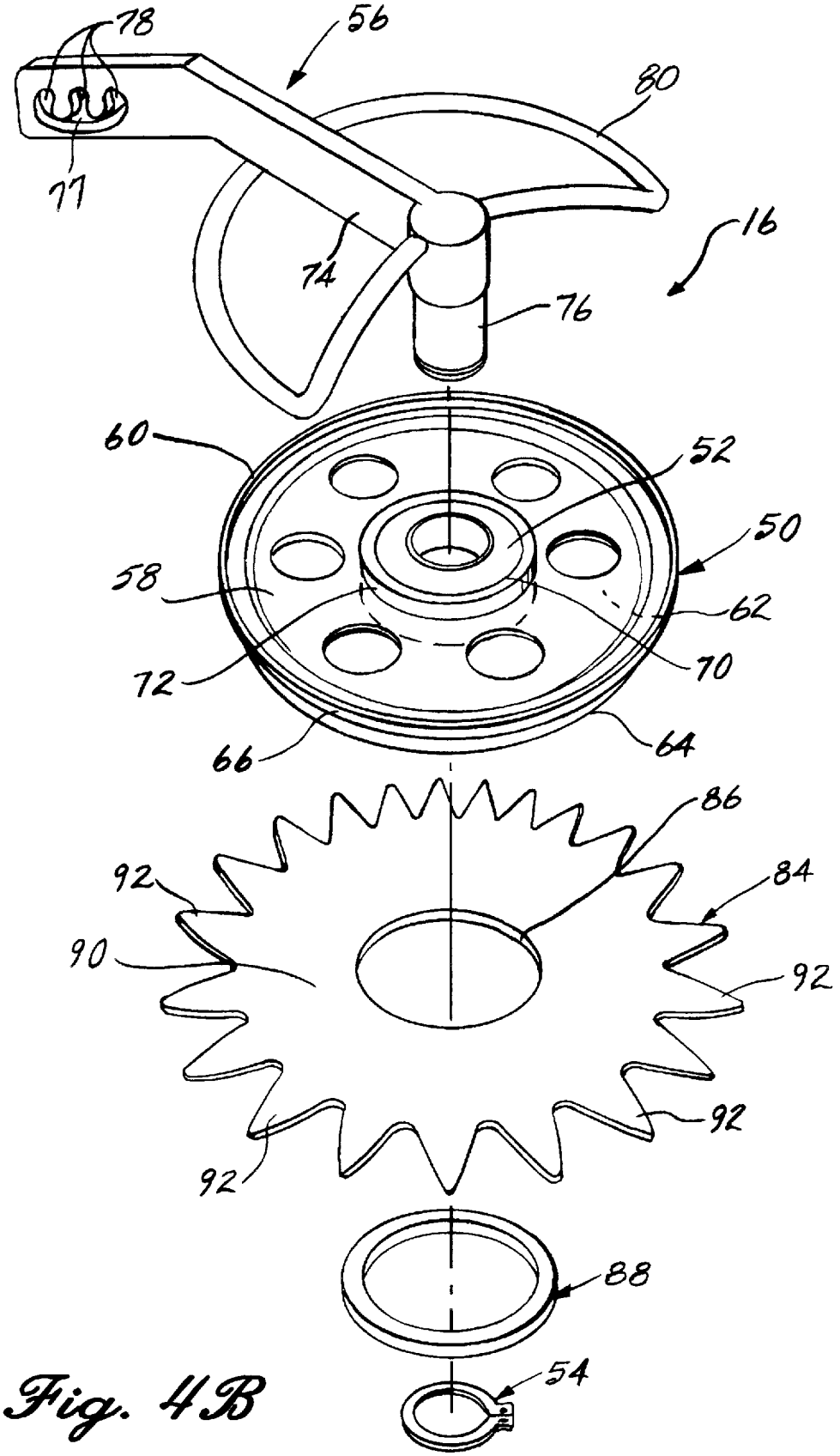
FIG. 4B is an exploded perspective view of a logging block formed in accordance with the present invention, wherein the logging block includes a sheave having a side plate comprising a plurality of radially extending teeth rotatably coupled adjacent the sheave.

In the alternate sheave assembly set forth above with reference to FIG. 4B, the use of an additional, rotatably independent side plate overcomes, in part, the disadvantages associated with the operation of the sheave assembly described above. Referring to FIG. 5B, when hook 28 contacts side plate 84 along an angled side of a tooth 92 or on the end of a tooth (as depicted by the phantom lines in FIG. 5B), hook 28 causes side plate 84 to rotate forward or backwards to a position where the hook is centered at the bottom of trough 94 between adjacent teeth 92.

Figures 6A, 6B:
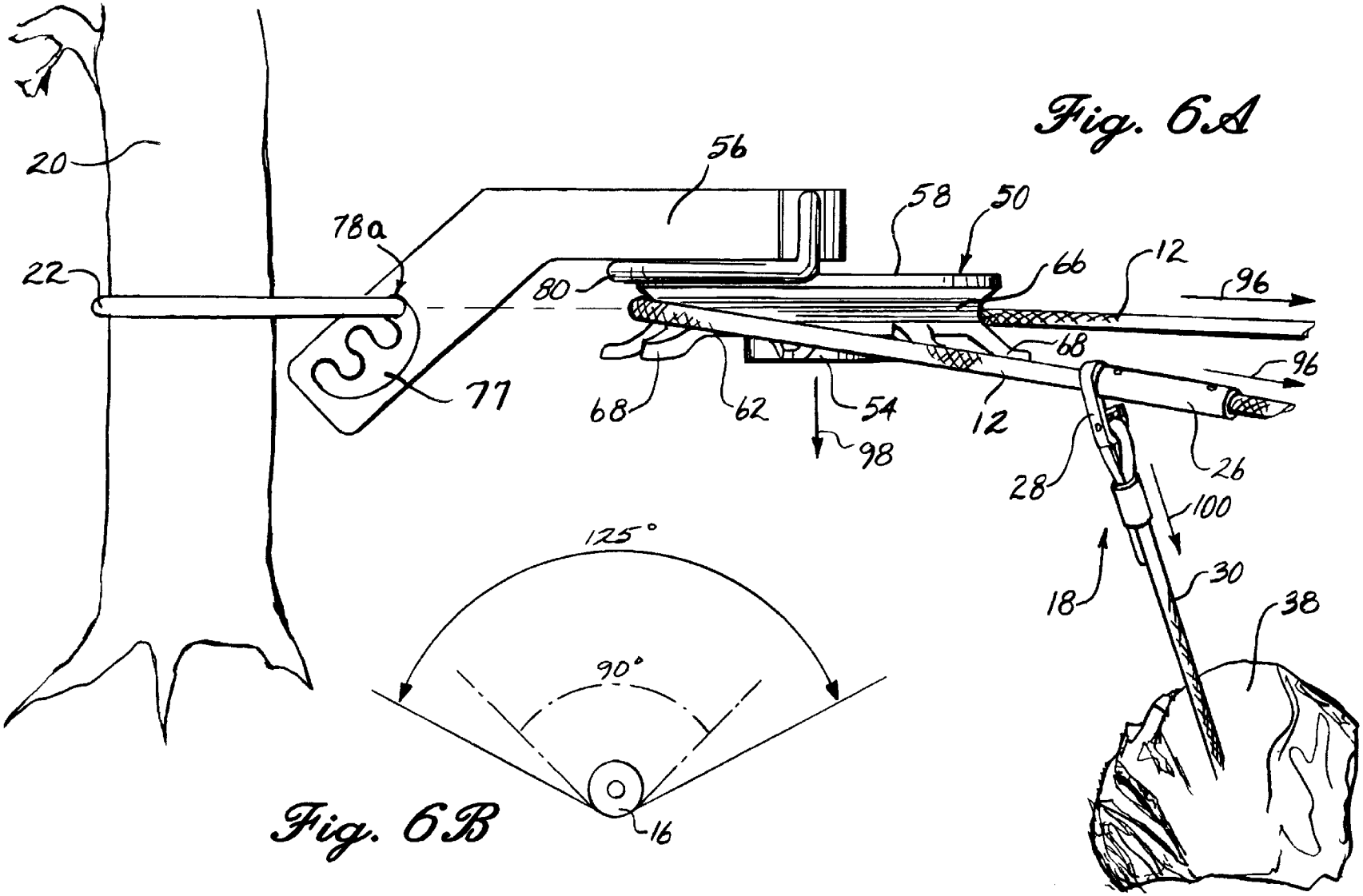
FIG. 6A is a side view of a logging block formed in accordance with the present invention in operation and secured to a tree via a mounting harness attached to a mounting assembly of a frame of the logging block, wherein the mounting harness is aligned with a sheave of the logging block to provide a mono-cable path mounting range between approximately 90° and 125°.
FIG. 6B is an overhead geometric view of a portion of a mono-cable system employing a logging block formed in accordance with the present invention showing the angular range of the mono-cable among adjoining logging blocks using the mounting harness alignment of FIG. 6A.

By reference to FIGS. 6–8, a better understanding of the operation and advantages of a logging block formed in accordance with the present invention can be achieved. Referring to FIG. 6A in conjunction with FIG. 6B, a logging block formed in accordance with the present invention secured to mounting tree 20 via mounting harness 22 is shown. In the operation of the mono-cable system using the improved logging block, harness 22 secures frame 56 and corresponding sheave 50 of the logging block to mounting tree 20 via mounting slot 78*a* of mounting assembly 77. The mounting slot is positioned such that mounting harness 22 slotted therein is aligned with groove 66 of sheave 50 located between upper side 58 and lower side 62 of the sheave when the center of the mounting slot is viewed in a plane parallel to the upper and lower sides of the sheave. As part of the traditional operation of the logging block as part of the mono-cable system, cable 12 travels along groove 66 of the sheave pulling log-securing assembly 18 and corresponding secured log 38 along mono-cable path 32. In this alignment, the outward force of cable 12, indicated by arrows 96, is resisted by harness 22 holding logging block 16 proximate to the mounting tree, and overcomes downward force of gravity 98 urging the logging block to fall against the tree. Secured log 38 has a force indicated by arrow 100, which tends to pull the cable 12 beyond radial protrusions 68 and off sheave 50. Unless the sheave is able to twist towards the approaching weighted cable so as to maintain the cable in the groove of the sheave, force 100 will ultimately cause the cable to jump the block. Adequate sheave twisting, in turn, is accomplished by maintaining the necessary balance among the three forces 96, 98, and 100.

To maintain the proper balance among the three forces 96, 98 and 100, sufficient surface area of cable 12 must be present along groove 66 of sheave 50 to force the sheave to twist as opposed to the cable jumping the block. In the past, this has been accomplished by maintaining the angle at each particular logging block between adjacent blocks to either side between approximately 90° and 125°, thus ensuring sufficient cable contact with the sheave. As long as the adjacent logging blocks were placed in the same relative plane and proximately distanced from each other to allow the sheave enough flexibility to twist, the likelihood of the cable jumping the block was relatively low. But if the topography of the logging area forces violation of the angular restriction—reducing cable contact with the sheave—or otherwise reduces the flexibility of the sheave to twist, the likelihood of the cable jumping the block dramatically increases.

While balancing each of the forces is important, maintaining the necessary angle between adjacent logging blocks is most difficult. Adjusting the height and placement of adjacent logging blocks on nearby trees is generally much easier than positioning the blocks to guarantee the jagged nature of a meandering mono-cable path necessary to avoid violating the angular restriction. Moreover, attempts to overcome this angular restriction have heretofore been unsuccessful. Decreasing the angle below 90° increases force 96, which in turn causes the cable to crawl toward upper side 58 of sheave 50, ultimately pulling the cable off the sheave and wedging it between the frame and the sheave. As a practical matter, an angle less than 90° doubles the mono-cable path back upon itself and is essentially a worthless operation in the logging process. An angle greater than 125°, on the other hand, would be quite useful. But with conventional logging blocks, an angle greater than 125° reduces the amount of cable in contact with the surface area of the groove of the sheave at any given moment, thereby decreasing cable force 96 away from harness 22. This causes the cable to be pulled along radial protrusions 68 and ultimately to jump off sheave 50 because of force 100 of secured log 38 downward and away from the harness.

Figure 7A:
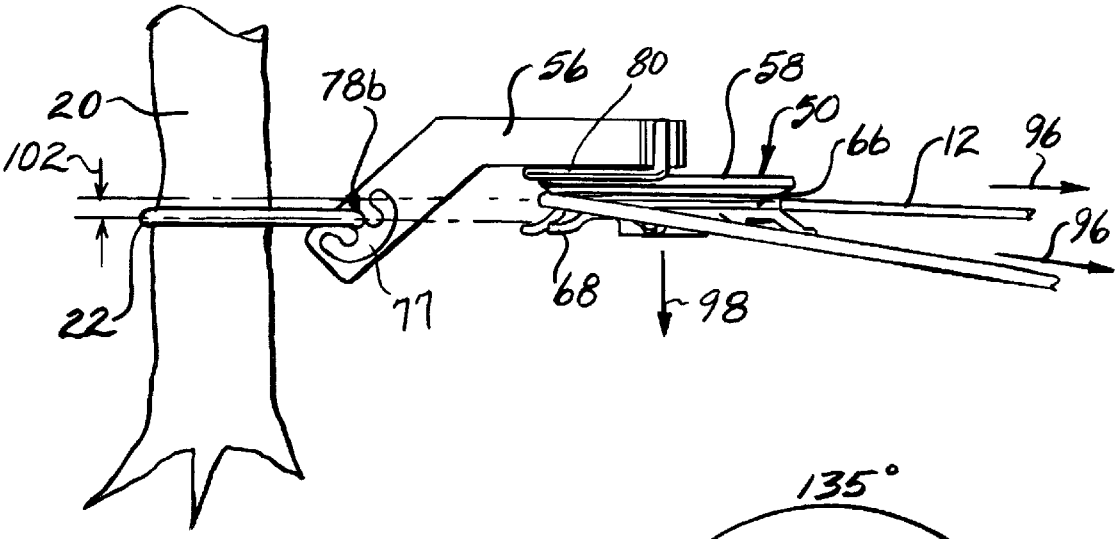
FIG. 7A is a side view of a logging block formed in accordance with the present invention in operation and secured to a tree via a mounting harness attached to a mounting assembly of a frame of the logging block wherein the mounting harness is offset below alignment with the sheave to provide a mono-cable path mounting range between approximately 100° and 135°.
Figure 7B:
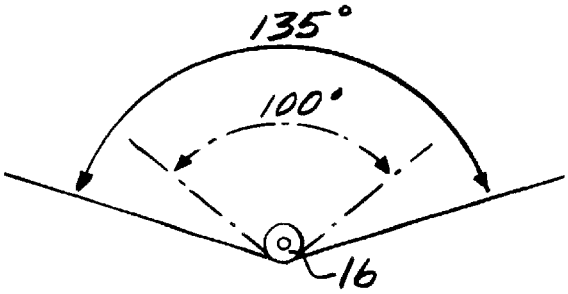
FIG. 7B is an overhead geometric view of a portion of a mono-cable system employing a logging block formed in accordance with the present invention showing the angular range of the mono-cable path among adjoining logging blocks using the mounting harness alignment of FIG. 7A.

To overcome much of the angular restriction without increasing the likelihood that the cable will jump the block, a preferred embodiment of the improved logging block made in accordance with the present invention provides additional mounting slots 78*b* and 78*c* in mounting assembly 77. The alignment of mounting slots 78*b* and 78*c* with respect to sheave 50 differs from that of mounting slot 78*a*. In the illustrated embodiment, both mounting slots 78*b* and 78*c* are aligned with or below lower side 62 of the sheave. Referring now to FIGS. 7A and 7B, securing frame 56 and sheave 50 to mounting tree 20 using mounting slot 78*b* alters how harness 22 resists downward force of gravity 98 as well as force 100 of secured log 38 and log-securing assembly 18 as cable force 96 is changed. In other words, alignment of mounting harness 22 and corresponding mounting slot 78*b* with respect to the sheave affect the cable force required to maintain the sheave in a substantially horizontal position, essentially parallel with the ground, or twisted to alignment with the weighted cable, depending on downward forces 98 and 100.

More specifically as shown in the illustrated embodiment, by using mounting slot 78*b* aligned below groove 66 of sheave 50, with all other forces being equal, the tendency of cable 12 is to crawl toward upper side 58 of the sheave. Given this tendency, less cable force 96 is required (and therefore less contact is needed between the cable and the surface of the groove of the sheave at any given moment) to prevent downward force 100 of secured log 38 from pulling the cable over radial protrusions 68 and off the bottom of the sheave. This is true even if the sheave is not able to twist as much to align itself with the weighted cable either because of less cable contact with the sheave or variations in the relative plane or distance between adjacent logging blocks. Because less cable force 96 is required, the angular range among logging block positions—as well as the relative plane and distance between adjacent logging blocks—can be altered without increasing the likelihood that the cable will jump the block.

It has been demonstrated most directly that the angle at the logging block between adjacent logging blocks to either side can be increased roughly proportionate to the amount that mounting slot 78*b* is aligned below original mounting slot 78*a*. In a preferred embodiment of a logging block having the general dimensions described above, for example, by aligning mounting slot 78*b* approximately one/half inch below mounting slot 78*a*, or approximately one/half inch below the center of sheave 50 (graphically represented by distance 102), the angular range among logging block positions increases from 90° to 125° to 100° to 135°. In other words, in the illustrated and described embodiment, an approximate one/half inch lower mounting slot translates to an approximately 10° higher angular range among adjacent logging blocks. It should be appreciated that due to the inter-relational nature among forces 96, 98, and 100, alterations in the relative plane or distance between adjacent logging blocks also affect the angular range achieved in the mono-cable system.

Figure 8A:
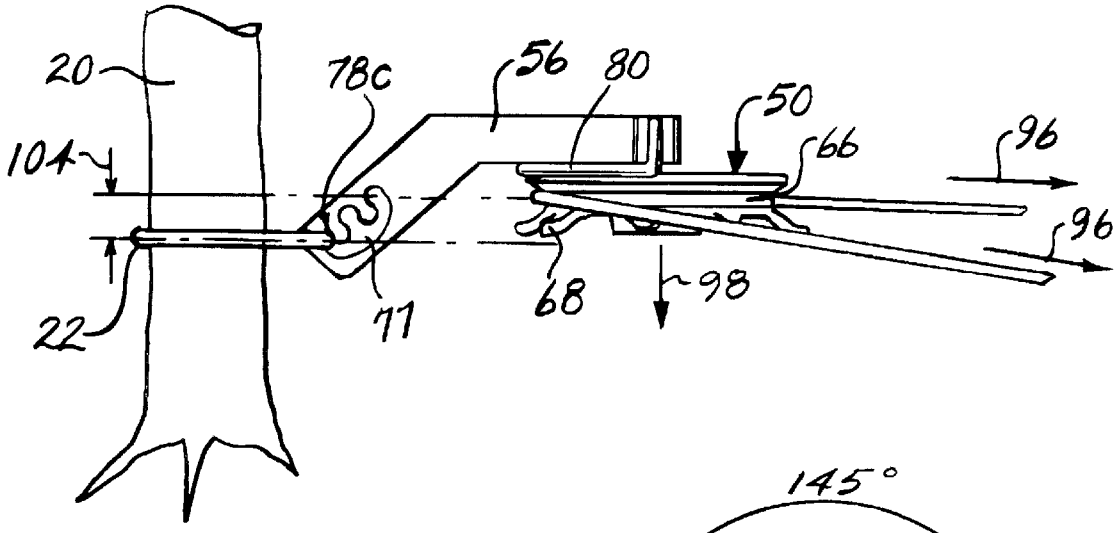
FIG. 8A is a side view of a logging block formed in accordance with the present invention in operation and secured to a tree via a mounting harness attached to a mounting assembly of a frame of the logging block, wherein the mounting harness is offset below alignment with the sheave to provide a mono-cable path mounting range between approximately 110° and 145°.
Figure 8B:
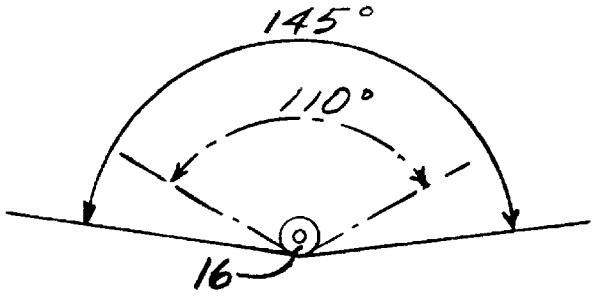
FIG. 8B an overhead geometric view of a portion of a mono-cable system employing a logging block formed in accordance with the present invention showing the angular range of the mono-cable path among adjoining logging blocks using the mounting harness alignment of FIG. 8A.

In a similar fashion, with reference to FIGS. 8A and 8B, securing frame 56 and sheave 50 to mounting tree 20 using harness 22 inserted into mounting slot 78*c* further alters how harness 22 resists downward force of gravity 98 as well as force 100 of secured log 38 and log-securing assembly 18 as cable force 96 is changed. Use of mounting slot 78*c* increases the tendency for cable 12 to crawl toward upper side 58, thereby requiring less cable force 96 to prevent downward force 100 of secured log 38 from pulling the cable over radial protrusions 68 and off the bottom of the sheave. Because less cable force 96 is required, the high end of the range among adjacent logging block positions can be further increased without increasing the likelihood that the cable will jump the block. More specifically, it has been demonstrated that use of mounting slot 78*c*, which is approximately one/half inch below mounting slot 78*b* and a full inch below mounting slot 78*c* and the center alignment of the sheave (graphically represented by distance 104), translates to a range of 110° to 145°.

It should be understood that while the particular embodiment of the logging block described above provides a mounting assembly having three mounting slots approximately one/half inch apart along the frame, the use of three mounting slots, and the distance between each mounting slot, is exemplary of the current best mode at this time. It should be understood by those skilled in the logging art that the illustrated embodiment is just one configuration, and that alterations in the type of mounting assembly, including the number of mounting slots used, the distance between each mounting slot along the frame, and the specific alignment of each mounting slot with respect to the sheave, is highly dependent upon the logging environment and the mono-cable system with which the logging block is used.

While the preferred embodiment of the invention has been illustrated and described, it will be appreciated that various changes can be made therein without departing from the spirit and scope of the invention.

The embodiments of the invention in which an exclusive property or privilege is claimed are defined as follows:

1. A logging block for use in a mono-cable system having a continuous loop of cable strung through a logging area along a mono-cable path that logs are to be conveyed, comprising:

(a) a frame having a first end and an opposing second end, wherein a mounting assembly providing at least two mounting slots is located at the first end for securing said frame to a stationary object along the mono-cable path, the at least two mounting slots of the mounting assembly being spaced from each other to provide a plurality of selectable mounting positions for the frame relative to the stationary object; and (b) a sheave having an upper side and an opposing lower side, wherein said sheave is rotatably coupled to the second end of said frame such that the sheave rotatably contacts the continuous loop of cable as the cable travels along the mono-cable path.

2. The logging block of claim 1, wherein the mounting assembly includes at least one mounting slot aligned between the upper side and the opposing lower side of the sheave.

3. The logging block of claim 1, wherein the mounting assembly includes at least one mounting slot offset from alignment between the upper side and the opposing lower side of the sheave.

4. The logging block of claim 1, wherein:

(a) the upper side includes a peripherally extending rib;

(b) the lower side includes a peripherally extending rib; and (c) a groove having a bottom is defined between the peripherally extending ribs of the upper and lower sides such that the bottom of the groove has a diameter less than the diameter of the peripherally extending ribs of the upper and lower sides.

5. The logging block of claim 1, wherein the lower side includes a peripherally extending rib having radial protrusions.

6. The logging block of claim 5, wherein the lower side is substantially round and the radial protrusions are equally spaced around a periphery of the lower side.

7. The logging block of claim 5, wherein the radial protrusions are substantially triangular in shape.

8. The logging block of claim 5, wherein the radial protrusions number greater than nine.

9. The logging block of claim 5, wherein a groove having a bottom is defined between the radial extending rib of the lower side and the upper side.

10. The logging block of claim 9, wherein:

(a) the groove has a first diameter;

(b) the radial protrusions include radial ends; and (b) a circle that substantially circumscribes the radial ends defines a second diameter that is greater than the first diameter.

11. The logging block of claim 9 wherein:

(a) the groove has a first diameter;

(b) the upper side includes a peripherally extending rib; and (c) the upper side has a second diameter that is greater than the first diameter.

12. The logging block of claim 1, further comprising a side plate secured adjacent to said sheave and being rotatable relative to said sheave, said side plate including a plurality of radial protrusions.

13. The logging block of claim 12, wherein said side plate is substantially round and the radial protrusions are equally spaced around a periphery of said side plate.

14. The logging block of claim 13, wherein the radial protrusions are substantially triangular in shape.

15. The logging block of claim 12, wherein the radial protrusions number greater than nine.

16. The logging block of claim 12, wherein said side plate is secured adjacent the lower side and a groove having a bottom is defined between the side plate and the upper side.

17. The logging block of claim 16, wherein:

(a) the groove has a first diameter;

(b) the radial protrusions of said side plate include radial ends; and (c) a circle that substantially circumscribes the radial ends defines a second diameter that is greater than the first diameter.

18. The logging block of claim 16, wherein:

(a) the groove has a first diameter;

(b) the upper side includes a peripherally extending rib; and (c) the upper side has a second diameter that is greater than the first diameter.

19. The logging block of claim 12, wherein the sheave and side plate rotate about a common axis.

* * * * *

UNITED STATES PATENT AND TRADEMARK OFFICE

CERTIFICATE OF CORRECTION

PATENT NO. : 5,868,381

DATED : February 9, 1999

INVENTOR(S) : G.E. Dahlstrom

It is certified that error appears in the above-indentified patent and that said Letters Patent is hereby corrected as shown below:

| COLUMN | LINE | | | |
|---|---|---|---|---|
| [56] | Refs. Cited (U.S. Patents) | please insert the following references: | | |
| | | --1,556,819 | 10/1925 | Hires |
| | | 2,608,935 | 09/1952 | Moore et al. |
| | | 2,652,157 | 09/1953 | Wyssen |
| | | 3,012,518 | 12/1961 | Sawyer et al. |
| | | 3,339,497 | 09/1967 | Bancel |
| | | 3,805,706 | 04/1974 | Bancel |
| | | 4,023,502 | 05/1977 | Elsing |
| | | 4,238,038 | 12/1980 | Fikse |
| | | 4,458,603 | 07/1984 | Voecks |
| | | 4,523,525 | 06/1985 | Foster |
| | | 4,584,945 | 04/1986 | Tupper |
| | | 4,782,761 | 11/1988 | Asberg |
| | | 4,920,892 | 05/1990 | Pesek-- |
| [56] | Refs. Cited (Foreign Patents) | After the U.S. References insert --FOREIGN PATENT DOCUMENTS | | |
| | | 69,978 | 1/1893 | Germany |
| | | 1,291,470 | 2/1987 | Soviet Union-- |

UNITED STATES PATENT AND TRADEMARK OFFICE

CERTIFICATE OF CORRECTION

PATENT NO. : 5,868,381

DATED : February 9, 1999

INVENTOR(S) : G.E. Dahlstrom

It is certified that error appears in the above-indentified patent and that said Letters Patent is hereby corrected as shown below:

| COLUMN | LINE | |
|---|---|---|
| 12 (Claim 9, | 66 line 2) | "radial" should read --peripherally- |

Signed and Sealed this

Tenth Day of August, 1999

*Attest:*

Q. TODD DICKINSON

*Attesting Officer*

*Acting Commissioner of Patents and Trademarks*